US005890229A

United States Patent [19]

Esposito

[11] Patent Number: 5,890,229

[45] Date of Patent: Apr. 6, 1999

[54] HAIR POUCH

[76] Inventor: Pamela Esposito, 1385 W. Hartley Cir., Deltona, Fla. 32725

[21] Appl. No.: 972,876

[22] Filed: Nov. 18, 1997

Related U.S. Application Data

[63] Continuation-in-part of Ser. No. 686,915, Jul. 26, 1996, abandoned.

[51] Int. Cl.[6] ..... A42B 1/04

[52] U.S. Cl. ..... 2/174; 2/171

[58] Field of Search ..... 2/174, 171; 34/96; 74/558, 558.5

[56] References Cited

U.S. PATENT DOCUMENTS

| | | | |
|---|---|---|---|
| 1,997,738 | 4/1935 | Maxedon et al. | 74/558.5 |
| 2,263,418 | 11/1941 | Gamin | 2/174 |
| 2,804,695 | 9/1957 | Scott | 34/95 |
| 4,458,738 | 7/1984 | Wilson | 74/558 |
| 5,249,308 | 10/1993 | Blume | 2/174 |

*Primary Examiner*—Diana L. Biefeld
*Attorney, Agent, or Firm*—Law Offices of Brian S. Steinberger; Brian S. Steinberger

[57] ABSTRACT

A hair pouch for being worn over wet hair. The pouch has an opening end with a resilient band and a baggy pouch consisting solely of a terry cloth type material. When worn, the weight of baggy portion causes the pouch to hang downward while resting against the wearer's hair causing the hair to flatten out. Wearing this hair pouch eliminates dripping after showers and helps to keep hair dry while working or playing in hot and humid conditions. Furthermore, the pouch allows the wearer to apply makeup without having the wet hair drip. The hair pouch can be worn by person's with long hair, short hair and by chemotherapy patients. The pouch can also be used as a steering wheel cover to protect the steering wheel from the effects of the sun while a vehicle is parked keeping the steering wheel cool so as not to burn a driver's hands.

9 Claims, 2 Drawing Sheets

HAIR POUCH

This invention relates to a water absorbing cover, and in particular to a baggy pouch made of a water absorbant material to be worn on a person's head to absorb water and by its weight hangs downward, rests against and flattens the hair. This is a Continuation-In-Part of U.S. application Ser. No. 08/686,915 filed on Jul. 26, 1996 now abandoned.

BACKGROUND AND PRIOR ART

People with long hair, especially women, have experienced the annoyance of water dripping from their hair after getting their hair wet from a shower, swimming, or other activities which cause the hair to become saturated with water. This dripping water prevents the rest of the body from getting dry and makes one cold. Furthermore, the dripping hair can restrict women from being able to apply makeup until their hair is dry. In the past, most women have wrapped a towel around their heads to stop the dripping water. However, wrapped towels don't stay in place for very long and eventually fall off. Moreover towels are cumbersome to use and afterwards bulky to launder, dry and fold for reuse. In addition, due to the lack of a device to help absorb extra water after a shower, extensive use of a blow dryer is often necessary which can be damaging to ones hair. Also if a person works or plays outside in hot or humid weather, such as when playing golf, sweat can make the hair very wet which then drips into the face and the eyes often affecting performance. Not even a ball cap would help in such conditions.

Various attempts have been made in the prior art patents but have failed to overcome the problems presented above. Comments about these patents will now be described.

U.S. Pat. No. 2,804,695 to Scott describes a device for drying wet hair. However, Scott U.S. Pat. No. '695 requires their cap device be made out of "rubber, plastic" having a "series of openings" in the cap so that "air circulates into the . . . openings", and a second inner layer of "coarse mesh" for allowing for the "air circulation" about a wearer's head, column 1, lines 49–61. The Scott patent does not allow for the hair to be flattened and does not hang downward from the wearer's head.

U.S. Pat. No. 5,248,308 to Blume describes an after shower hat made of absorbent pieces of material with an elastic band sewn in to the opening perimeter. However, Blume U.S. Pat. No. '308 requires vertical "stiffening material/strips" sewn into opposite sides to prevent crushing of the hair, abstract. Blume is a rigid device that requires that the "hat will stand relatively straight when worn . . . preventing the hair from becoming flattened", column 2, lines 42–45. Thus, the Blume patent does not flatten the hair of the wearer and does not hang downward from the wearer's head.

U.S. Pat. No. 1,577,945 to Blumenthal describes a cap towel made of absorbent material having a tie string. U.S. Pat. No. 2,470,833 to Moore describes another hair drying cap made of water absorbent material with a tie, string and straps. U.S. Pat. No. 2,493,363 to Sapp teaches a hair drying cap made of pieces of absorbent material. U.S. Pat. No. 2,694,204 to Cross describes a hair drying turban with straps around the opening and tie corners at the end. U.S. Pat. No. 5,490,528 to Day describes a special hair drying towel which consists of a regular towel having snaps on one end and straps on the other end to hold the twisted towel to a persons head. And Canadian patent 453,761 describes a hair drying bonnet made of multiple layers of absorbent material using tie straps.

Although there are many hair drying caps and towels in the prior patented art none has the same structure or is made in the same manner to provide the same benefits of the present invention. Thus, a need exists for a simple, easy and quick to use device that will keep hair from dripping and absorb the excess water.

SUMMARY OF THE INVENTION

The first objective of the present invention is to provide a hair pouch that keeps the hair from dripping after it gets wet from a shower, swimming or perspiration.

The second object of this invention is to provide a hair pouch to help absorb extra water.

The third object of this invention is to reduce the need for extensive use of a blow dryer thereby preventing hair damage.

The fourth object of this invention is to provide such a device that is easy and quick to use.

The fifth object of this invention is to provide a device that is easy to wash, dry, and reuse.

The sixth object of this invention is to provide a wearable hair pouch that rests against and flattens the hair.

The seventh object of this invention is to provide a baggy hair pouch whose weight causes the wearer's hair to hang downward.

The eighth object of this invention is to provide a baggy hair pouch that is formed solely of a terry cloth type material and has not extra materials such as stiffening members.

The novel hair pouch is worn over wet hair. The pouch can be constructed of a circular piece of absorbent material having a desired perimeter. A resilient portion, such as an elongated elastic band, is sewn into the inward folded perimeter of the moisture absorbent material such as terry cloth. The resulting pouch has a top hair holding portion having an opening with a resilient portion for securing and comfortably holding the pouch to the head of the wearer. Unlike many devices of the prior art the method of constructing the hair apparatus would comprise cutting a circular piece of moisture absorbent material having a desired perimeter, sewing an elongated strip of elastic material into a folded over perimeter of said circular piece to form a soft, flexible apparatus. The hair holding portion of the pouch has a baggy interior and exterior appearance that when worn tends to hang downward. A lighter seven ounce version of the pouch can be worn by chemotherapy patients. Unlike the prior art, the novel baggy pouch of the subject invention by its weight rests against and flattens the hair of the wearer.

The novel pouch can be used as a steering wheel cover to both protect the steering wheel from the effects of the sun to keep from burning one's hands after being parked in the sun for long periods of time, and as a more comfortable gripping surface Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
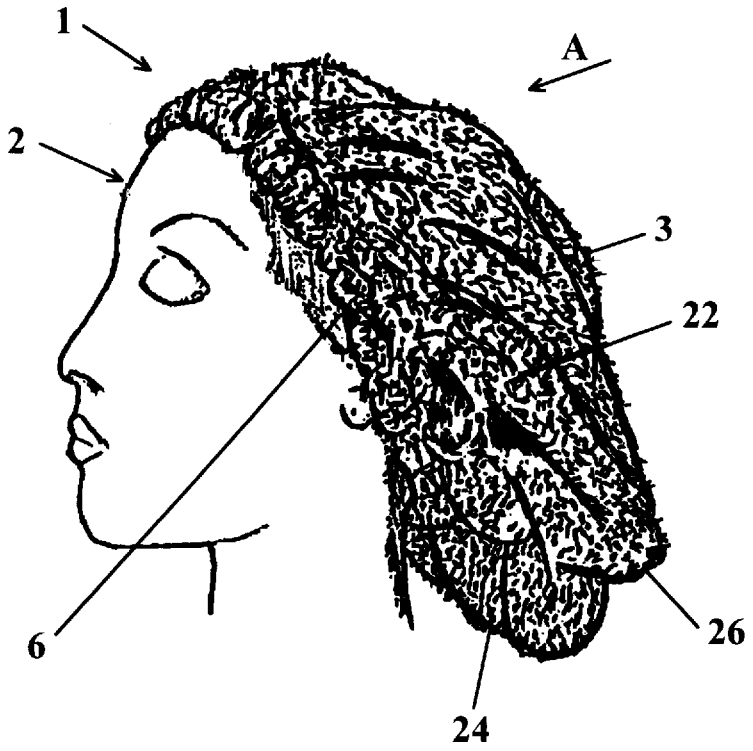
FIG. 1 is a side view of the hair pouch being worn by a person.
Figure 2:
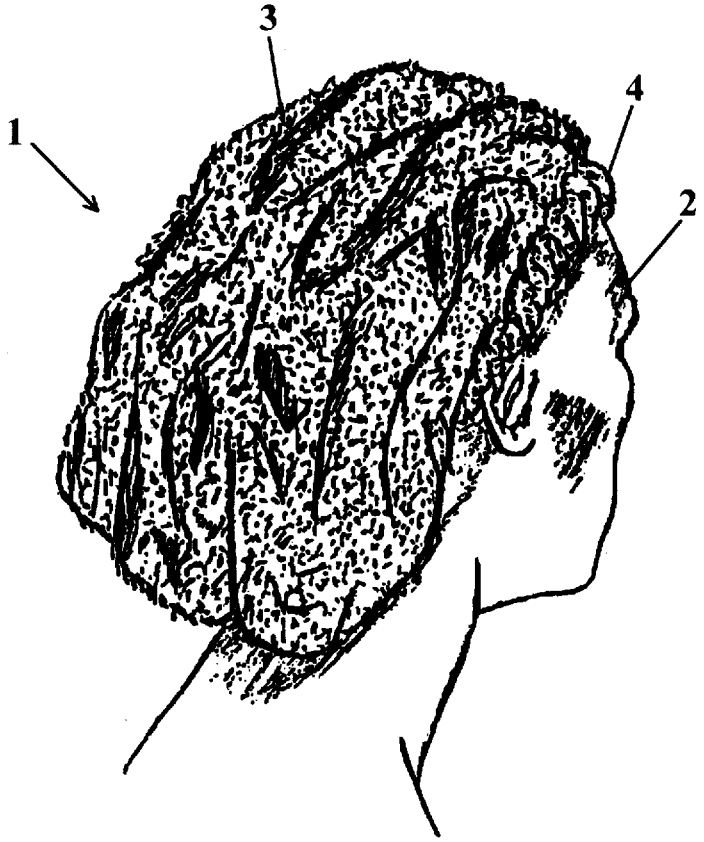
FIG. 2 is a rear view of the hair pouch of FIG. 1 along arrow A.

FIG. 1 is a side view of the hair pouch 1 being worn by a person 2. FIG. 2 is a rear view of the hair pouch 1 of FIG. 1 along arrow A. Referring to FIGS. 1–2, hair pouch 1 is worn by a person 2, as constructed the hair pouch as a top holding portion 3, a resilient, elastic rim, 4 around the opening perimeter 6 to hold the device comfortably on the head of the wearer. The resilient portion is formed by sewing an elastic, resilient material in a rim 4 the opening perimeter 6, along the sew line 5 so that the elastic is free floating within a fold-over around the perimeter.

When the pouch 1 is in an unused state it is flexible and fluffy due to the excess of material in the center of the pouch. As such, the pouch contains no strap or stiffeners so the inside hair holding portion 3 rests against the wearer's hair to absorb moisture and expedite drying of the hair. By resting against the hair of the wearer 2, the pouch 1 flattens the hair by having baggy portions 22, 24, 26 hang downward against by the force of gravity against the wearer's hair.

Figure 3:
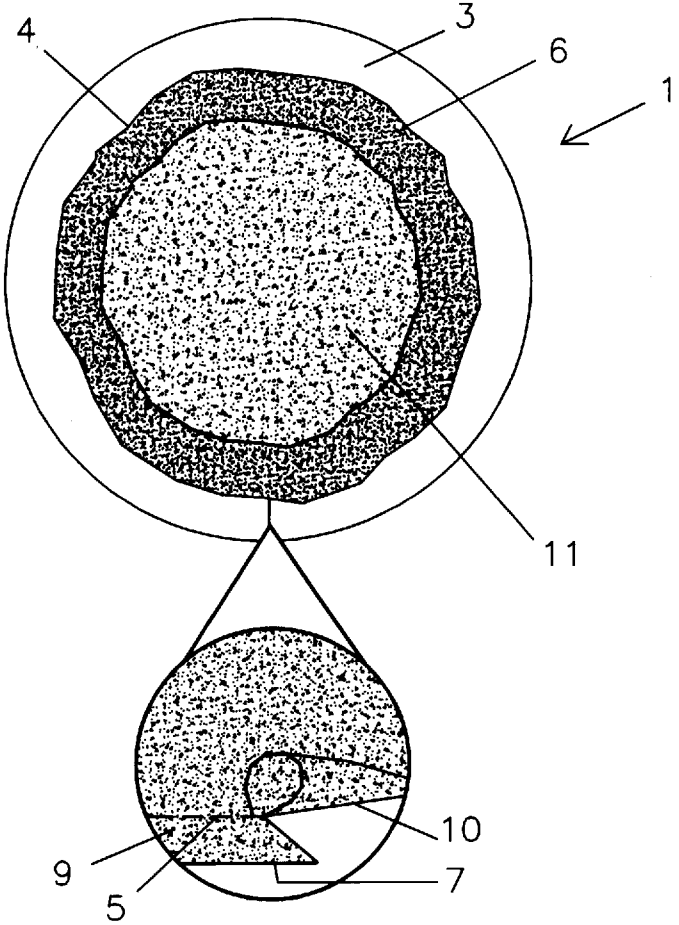
FIG. 3 is a bottom view of the hair pouch with an enlarged view of the elastic rim.

Referring to FIG. 3, the hair pouch 1 is made from a pattern consisting of a circular piece of material having a desired perimeter 7 which is determined by the size of the pouch to be made. The pattern for the device may also contain a ring 9 for positioning the resilient material to be sewn into the perimeter between the sew line 5 and the opening of the hair pouch 6. A large, inside central portion 11 of the hair pouch forms the hair holding portion 3 of the device.

Figure 4:
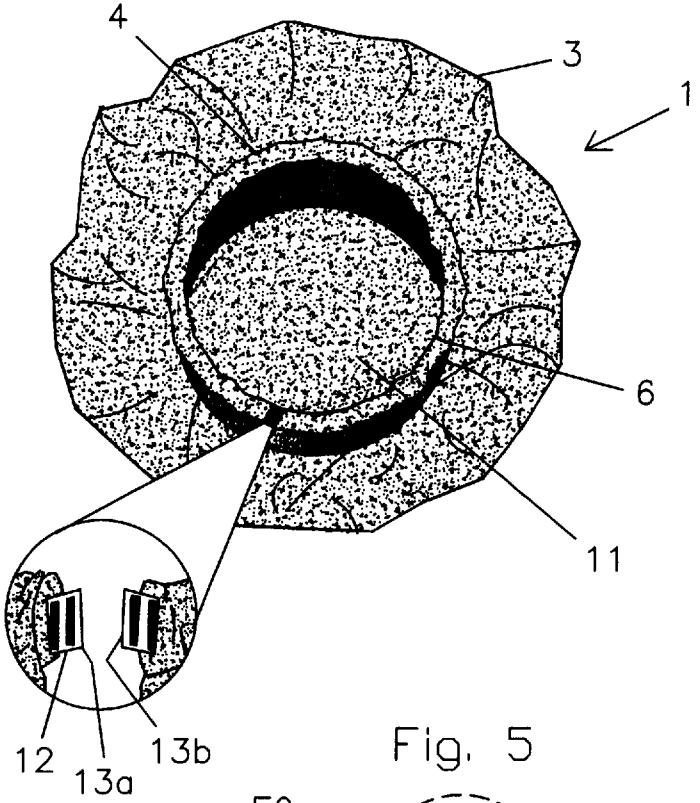
FIG. 4 is a perspective bottom view of the hair pouch of FIG. 3 with an enlarged cutaway view of the elastic rim.

Referring to FIG. 4 the strip of elastic material 12 with two ends 13*a* and 13*b* are illustrated. The elastic strip 12 would be cut so it would be less than the perimeter 7 of the pattern so that it would provide a secure yet comfortable fit for the hair pouch worn when it is worn by a person. The elastic band 12 is sewn into the perimeter along the sew line 5, FIG. 3. Also the elastic strip 12 is covered by the overlapping portion 10 of the circular pattern to form the resilient portion 4. Constructing the pouch in this manner provides a pouch wherein the inner layer is made entirely of moisture absorbent material and there is no direct contact between the wearer's hair and the elastic strip 12 eliminating the possibility of the wearer's hair becoming tangled with the elastic strip 12 and causing discomfort to the wearer.

The method of constructing the present hair apparatus involves first cutting a circular piece of moisture absorbent material of a desired perimeter depending on the ultimate size of the hair pouch. Then a strip of elastic material is cut which has an ultimate length less than the perimeter of moisture absorbent material. Then the strip of elastic material is placed sufficiently inward of the outer perimeter of the circular piece of moisture absorbent material so as to leave enough material to fold over and cover the strip entirely and to be sewn to the absorbent material.

The overall weight of the subject invention hair pouch can be approximately nine (9) ounces where one size fits all.

Although this invention could be made of almost any moisture absorbent material it will probably be made of terry cloth which is good for absorbing moisture but also allows air to permeate it. As described herein-above the objects and advantages of this invention should be readily apparent. The device can be use to absorb water from the hair after washing, swimming, or anytime the hair is wet, thereby avoiding dripping of water on the face, neck, or clothes. It can even be used to keep hair dry in the shower, Jacuzzi, or steam bath. Women can use the hair pouch right after bathing and be able to apply makeup without concern for the effects of dripping hair. Using the device would replace the use of towels for wrapping hair thus avoiding the aggravation of towels falling off of the head and the dripping of water on the face, neck, and ears which takes place. The pouch would save the cost of laundering as compared to normal size drying towels, and the need to fold the towels, since the pouch can be simply placed in the dryer after use.

Over three thousand (3,000) of the novel hair pouch inventions have been sold on the QVC Home Shopping Network on a single day in Feb. 22, 1997. Through 1997, thousands more of the novel hair pouches have been sold through the QVC, the Southern Women's Show of Orlando, and through health and beauty shops in New York and Florida.

Although, the invention has been described as being used primarily with women having hair, the invention has utility with patients having hair loss due to the effects of chemotherapy and the like. A lighter pouch can be made of a thinner terry cloth material so that the overall weight of the hair pouch can be approximately 7 ounces.

Figure 5:
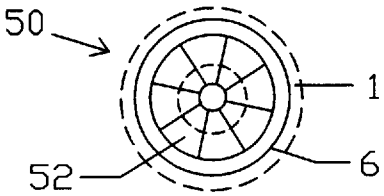
FIG. 5 is a perspective view of another embodiment of using the novel pouch of a steering wheel.

FIG. 5 is a perspective view of another embodiment 50 of using the novel pouch 1 on a steering wheel. The elastic strip portion 6 can be stretched about and around the outer gripping wheel portion 52 of a vehicle's steering wheel. Here, the pouch 1 can be used to both shield the steering wheel 52 from being heated up by the sun's rays, and as a more comfortable and cool gripping surface for the vehicle driver.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A baggy hair pouch for being worn over and resting against wet hair of a wearer for flattening the hair and causing the hair to hang downward without using stiffening members and without using exterior straps, the baggy hair pouch solely comprising:

a baggy pouch having an opening end for receiving wet hair of a wearer within the pouch, the baggy pouch having a closed end with separate baggy portions each baggy portion having convex curved exterior surfaces that drape and hang downward from the opening end, the baggy pouch consisting solely of a baggy moisture absorbent material; and a resilient portion around the opening end of the pouch for securing and comfortably holding the baggy pouch substantially over wet hair of a wearer without using stiffening members and without using exterior straps, wherein the pouch loosely rests against and flattens the wet hair of a wearer while the baggy pouch drapes over the wet hair and hangs downward.

2. The hair pouch of claim 1 wherein the resilient portion includes:

an elongated elastic strip sewn around and into an overlap of the moisture absorbent material around the perimeter of the resilient portion.

3. The hair pouch of claim 1, wherein the baggy moisture absorbent material includes:

terry cloth.

4. The hair pouch of claim 1, wherein the hair pouch has a weight of:

approximately 9 ounces.

5. The hair pouch of claim 1, wherein the hair pouch has a weight of:

approximately 7 ounces, for use by chemotherapy patients.

6. The hair pouch of claim 1, wherein the resilient portion includes:

an end flap of the baggy moisture absorbent material which is folded over and sewn together over an elastic strip.

7. The method of flattening wet hair using a baggy pouch of moisture absorbent material having a resilient band opening, and without using stiffening members and without using exterior straps, the method comprising the steps of:

constructing a baggy hair pouch having an open end with a resilient band and a main baggy section and a closed end, the main baggy section and the closed end having separate baggy portions each baggy portion having separate convex curved exterior surfaces, the baggy pouch consisting solely of a baggy moisture absorbent material; and stretching the resilient band substantially over wet hair of a wearer so that the main baggy portion and the closed end hangs downward while loosely resting against and flattening substantially all the wet hair of the wearer without using stiffening members nor exterior straps with the baggy pouch.

8. The method of flattening wet hair of claim 7, wherein the constructing step further includes:

folding over and sewing an end flap of the baggy moisture absorbent material over an elastic strip.

9. The method of flattening wet hair of claim 7, wherein the baggy moisture absorbent material is comprised solely of:

terry cloth.

* * * * *